United States Patent [19]

Nordin

[11] 4,087,973

[45] May 9, 1978

[54] UNBALANCED HYDRAULIC SYSTEM CAPABLE OF WORK

[76] Inventor: Lars-Gunnar Nordin, Stockholm, Sweden

[21] Appl. No.: 795,590

[22] Filed: May 10, 1977

Related U.S. Application Data

[63] Continuation-in-part of Ser. No. 584,441, Jun. 6, 1975, Pat. No. 4,024,714, which is a continuation of Ser. No. 450,538, Mar. 12, 1974, abandoned.

[30] Foreign Application Priority Data

Mar. 12, 1973 Sweden ..... 7303429

[51] Int. Cl.[2] ..... F15B 7/10

[52] U.S. Cl. ..... 60/572; 60/592

[58] Field of Search ..... 60/413, 464, 470, 472, 60/572, 592, 461

[56] References Cited

FOREIGN PATENT DOCUMENTS

| | | | |
|---|---|---|---|
| 487,288 | 10/1952 | Canada | 60/572 |
| 2,411,792 | 3/1974 | Germany | 60/592 |
| 680,291 | 8/1939 | Germany | 60/472 |

*Primary Examiner*—Edgar W. Geoghegan
*Attorney, Agent, or Firm*—Fred Philpitt

[57] ABSTRACT

Hydraulic input-output device working with a hydraulically unbalanced system. This is made possible according to the present invention by in a useful way taking advantage of the pressures, which arise upon actuation in a hydraulically unbalanced system, in that the created fluid differential can be translated to a fluid flow towards or away from a fluid accumulator.

1 Claim, 1 Drawing Figure

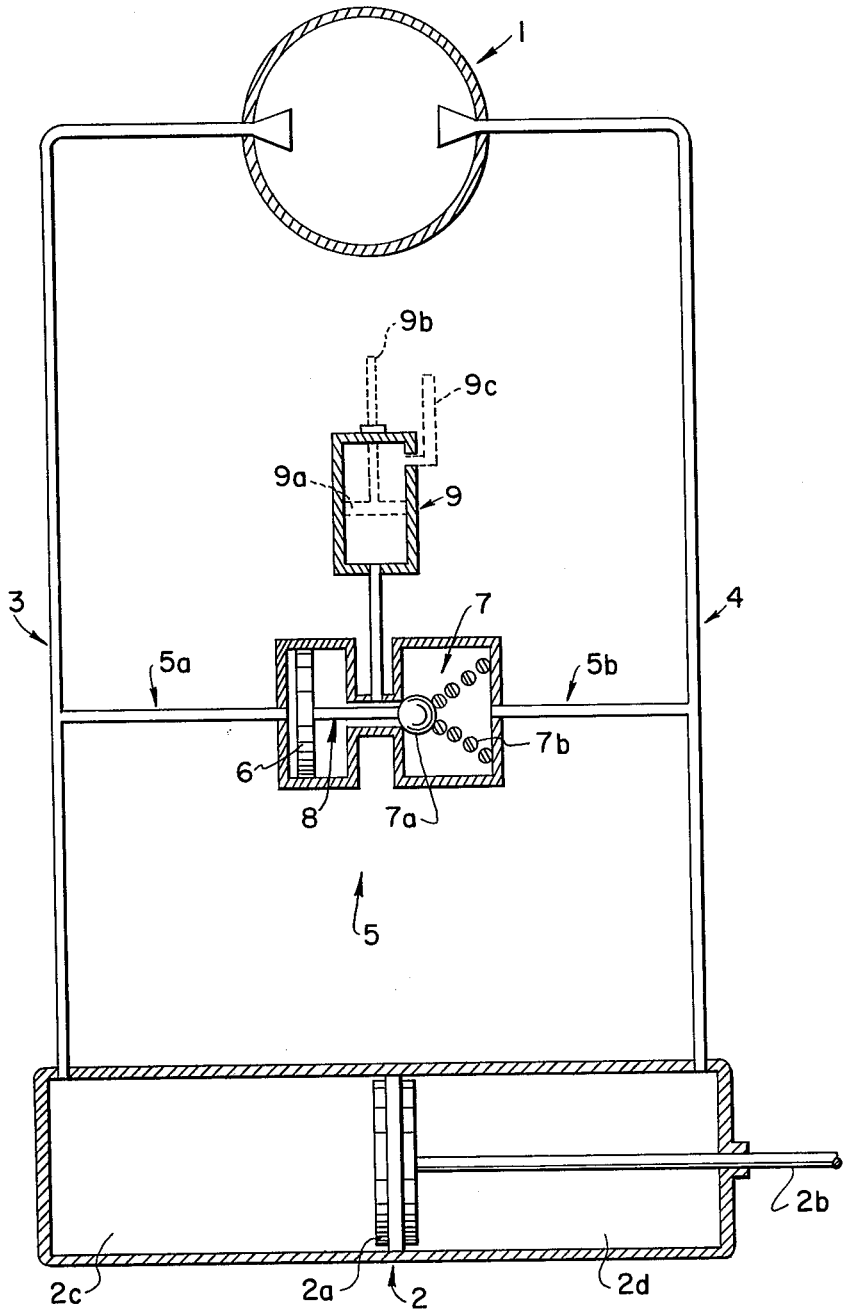
1
9b
9c
9a
9
3
4
7
5a
5b
7b
6
8
7a
5
2b
2c
2a
2
2d

UNBALANCED HYDRAULIC SYSTEM CAPABLE OF WORK

This application is a continuation in part of applicant's copending application, Ser. No. 584,441 filed June 6, 1975 now U.S. Pat. No. 4,024,714, issued May 24, 1977, which was a continuation of Ser. No. 450,583, filed Mar. 12, 1974, now abandoned.

BACKGROUND OF THE INVENTION

This invention relates generally to a hydraulic input-output device, and particularly to a device capable of translating a first movement of a certain magnitude into at least a second movement of a magnitude having a predetermined ratio to said first movement.

DESCRIPTION OF THE PRIOR ART

In the past, it has been customary to utilize hydraulic input-output devices for use in different fields of the arts. Such devices have, for example, been used for power transmitting, for general regulation and for translating of movements from a master to a slave unit.

In all occurring cases where a hydraulic input-output device is used, it has been deemed necessary to have the device hydraulically balanced, that is, a volume equal to the hydraulic fluid volume leaving the input side of the device, has to be accumulated by the output side of the device. In closed systems of the above type, the problem arises of relieving the pressure in the system upon rise in temperature, and of compensating for the variable volume of hydraulic fluid due to temperature variations.

In the Canadian Pat. No. 487,288 (Hebel et al) the problem is solved by adapting a fluid reservoir to both sides of the system.

SUMMARY

According to the present invention no particular steps are necessary to ensure compensation for volume variations due to temperature fluctuations, as the device itself and its way of working will admit these volume variations to be compensated. This is possible by making the device work as a unbalanced hydraulic device, that is, the device creates a volume differential during actuation equal to the increase or decrease of the internal volume of the device. The volume differential is translated as fluid flow toward and away from the fluid accumulator, which for instance can consist of a drive fluid actuating mechanism of another hydraulic input-output device, depending upon which purpose the device is supposed to serve. The purpose of the device can be power transmitting and/or indicating the positions of the drive fluid mechanism.

As one side of the device is separated from the other side of the device, to which other side the valve means and the accumulator are connected, and in consequence always contains a constant fluid amount, this fluid amount ensures the predetermined ratios between the movements of the first and second drive fluid operable mechanisms and eventually the movement of the accumulator being a third drive fluid operable mechanism.

One advantage of the present invention making an unbalanced hydraulic device operable is the possibility of using cheap and space-saving components and yet obtain a hydraulic input-output device, which automatically compensates for variable volume of fluid due to temperature fluctuations and which can perform in different fields of the art, such as powertransmitting and/or index regulating of movements.

BRIEF DESCRIPTION OF THE DRAWING

The FIGURE is a schematic view of a hydraulic input-output device in accordance with one embodiment of the invention and which can be used as a power transmitter and/or index regulator of movements.

GENERAL ARRANGEMENT AND FUNCTIONS

The shown embodiment of the hydraulic device comprises a first drive fluid actuating mechanism 1 and a second drive fluid operated mechanism 2, which are operatively connected via first and second hydrostatic lines 3 and 4. A passageway 5 extends between said first and second lines 3 and 4 and a movable barrier 6 separates this passageway 5 into a first and a second passageway portion **5*a* and 5*b*. Valve means 7 in said second passageway portion 5*b* and which is actuated by means 8 operatively connected with said barrier 6, controls the flow of fluid towards a fluid accumulator or a second drive fluid operable mechanism 9**.

Drive Fluid Actuating Mechanism

The drive fluid actuating mechanism shown in the embodiment according to the present invention is a double acting pump mechanism, which exerts equal fluid displacement upon actuation in both directions.

Drive Fluid Operated Mechanisms

The first drive fluid operated mechanism consists of a hydraulically unbalanced double acting piston-cylinder arrangement, that is, the arrangement can accumulate different fluid volumes in the two spaces **2*c* and 2*d* separated by the piston 2*a*. The maximum fluid volume differential is equal to the volume accommodated by the piston rod 2*b* in the space 2*d*** of the piston-cylinder arrangement.

An eventually second drive fluid operated mechanism 9 consists of a piston-cylinder arrangement, which simultaneously acts as a fluid accumulator and which can perform a certain work during movement of its piston **9*a*. The space above the piston 9*a* can either be vented to the atmosphere or may contain fluid, which, via the line 9*c*** can flow to an indexing instrument or eventually effect a servo control.

Movable Barrier and Valve Means

In the passageway 5 extending between the first and the second lines 3, 4 is moveable barrier means 6 arranged separating the passageway in a first and second portion **5*a*, 5*b*. One side of the barrier means 6 is exposed to the first hydrostatic line pressure and has a certain area being greater than the area of the valve means 7 exposed to the second hydrostatic line pressure. Between the barrier 6 and valve means 7*a* is valve actuating means 8 arranged operatively connected with the barrier 6. In the embodiment is the valve element 7*a* resilient mounted to a closing position in the second passageway portion 5*b* by a spring 7*b***. It is impossible to have the valve element arranged in a closing position by virtue of gravitation or the valve element can be controlled by the pressures in the system.

Fluid Accumulator

To the second passageway portion **5*b*, between the valve element 7*a* and the movable barrier 6, a fluid accumulator 9 is connected. The accumulator 9 can consist of a mere fluid receiving reservoir, but in the shown embodiment the reservoir has the shape of a cylinder, in which a movable piston 9a, eventually connected to a piston rod 9b, can be arranged. Depending upon what purpose the device according to the present invention is supposed to serve, the fluid accumulator arrangement 9 can be connected to an indexing instrument or to a servo control via the line 9c**.

DESCRIPTION OF THE PREFERRED EMBODIMENT

All elements necessary to the construction and operation of the complete hydraulic device of the invention are conventional and well known in the field of art. Consequently, it is the combination of the elements which makes the device work as intended, that is enabling a hydraulically unbalanced system to perform an operation.

For better understanding of the function of the shown preferred embodiment, the drive fluid acutating mechanism 1 could be substituted for a piston-cylinder arrangement, shown as a "slave unit" in my patent application Ser. No. 584,441. A double acting pump mechanism in the shown embodiment has, however, exactly the same function as a double acting piston-cylinder arrangement and the substitute is just suggested to facilitate the understanding of the device at work.

Presume the first drive fluid operated mechanism 2 shall be moved to the left: The pump 1 exerts fluid flow to the right side 2d of the mechanism — but as the hydraulic system of the device is hydraulically unbalanced and the barrier 6 separates the system in two distinct, from each other, fluid sealed, first 2c, 3, 5a and second 2d, 4, 5b sides — the fluid outflow from the side 2c of the mechanism 2 tends to be greater than fluid inflow owing to an increasing space demanded by the piston rod 2b during movement into the mechanism 2. This greater fluid outflow is transferred to the first side 2c, 3, 5a of the system at a pressure which effects the barrier 6 to move and open the valve element 7a, via the valve actuating means 8. In this stage a fluid flow will be directed from the second side 2d, 4, 5b of the system towards the fluid accumulator 9, via the passageway portion 5b and through the valve element 7a thus relieving the higher pressure in the first side of the system, which in turn effects the barrier 6 to "close" the valve means 7. In fact the valve means 7 is never closed during actuation of the pump mechanism 1 directing fluid flow to the right side 2d of the mechanism 2, but the function of the device can more easy be understood by such an explanation. What happens is that a constant movement to the left is transferred to the piston 2a by actuation of the pump mechanism 1, and a constant fluid flow is directed towards the accumulator 9 during this movement.

The fact that just a fluid flow corresponding to the space demand of the piston rod 2b moving into the mechanism 2 flows into the accumulator is due to the fact that the first side 2c, 3, 5a of the system is fluidly sealed from the second side 2d, 4, 5b of the system.

At the same time the barrier 6 tends to "close" the valve means 7, due to relief of pressure in the first side 2c, 3, 5a of the system, a movement of the piston 2a takes place and the above explained cycle repeats itself. It shall be understood that the pressure relief in the first side of the system takes place due to the face that the pump mechanism is allowed to transmit fluid from the first to the secnd side of the system. This is easily understood in the shown embodiment if the pump is replaced by a piston cylinder arrangement having a piston rod passing through one side of the cylinder. With this above mentioned replacement, it should be clearly understood, that without accumulating the fluid differential in the accumulator — that is without a passageway 5 and therein arranged elements — the hydraulic input-output device would not be able to transform movements.

The above mentioned actuation of the drive fluid actuating mechanism results accordingly in a decrease of the total internal volume of the two sides of the hydraulic system of the input-output device. The created fluid differential is accumulated by the accumulator.

An actuation in the other direction of the drive fluid actuating mechanism will result in an increase of said total internal volume. The piston 2a of the first drive fluid operated mechanism 2 will in this case be moved to the right. The fluid volume exerted from the space 2d of the mechanism is not sufficient — compared with the demanded fluid flow to the space 2c of the mechanism 2 — to transfer a movement to the piston 2a. A vacuum will appear in the second side 2d, 4, 5b of the system, which vacuum will effect the valve means 7 to open to admit a fluid flow from the accumulator 9 towards the second side of the system. The fluid flow from the accumulator 9 is equal to the fluid flow into it during actuation in the first mentioned reversed direction of the actuating mechanism.

It shall be understood that the excess pressure in the first side of the system and the vacuum in the second side of the system effects the barrier and the valve means respectively — depending upon direction of actuation of either of the drive fluid mechanisms 1, 2 — to admit a fluid flow toward and away from the acumulator respectively. Thus it is possible to use the mechanism 2 as the actuating mechanism and the mechanism 1 as the operated mechanism. This can easily be understood by reading the shown embodiment with the mentioned replacement of the pump mechanism 1 by a piston-cylinder arrangement. Accordingly a rotary movement can be transferred to a linear movement and vice versa.

I claim:

1. Hydraulic input-output device capable of translating a first movement of a certain magnitude into at least a second movement of a magnitude having a predetermined ratio to said first movement comprising in combination:

a. a drive fluid actuating mechanism;
b. a first drive fluid operated mechanism;
c. a first hydrostatic line operatively connecting said first and said second mechanisms;
d. a second hydrostatic line operatively connecting said first and said second mechanisms;
e. a passageway extending between said first and said second lines;
f. movable barrier means in said passageway separating said passageway into a first and a second passageway portion;
g. valve means in said second passageway portion;
h. valve actuating means operatively connected with said barrier means;
i. a fluid accumulator or a second drive fluid operated mechanism connected to said second passageway portion between said barrier and said valve means; wherein said volume differential being translated as fluid flow towards and away from said fluid accumulator via said second hydrostatic line and further via said second passageway portion and said valve means, said valve means being actuated by said barrier means to open passage to said accumulator by virtue of the area of said barrier means exposed to the first hydrostatic line pressure being greater than the area of said valve means exposed to the second hydrostatic line pressure.

* * * * *